US009162737B1

(12) United States Patent
Leatherman

(10) Patent No.: US 9,162,737 B1
(45) Date of Patent: Oct. 20, 2015

(54) LIFESAVING TOTE BAG

(76) Inventor: Stephen Parker Leatherman, Miami, FL (US)

( * ) Notice: Subject to any disclaimer, the term of this patent is extended or adjusted under 35 U.S.C. 154(b) by 0 days.

(21) Appl. No.: 13/507,140

(22) Filed: Jun. 7, 2012

Related U.S. Application Data

(60) Provisional application No. 61/520,815, filed on Jun. 15, 2011.

(51) Int. Cl.
*B63C 9/00* (2006.01)
*B63C 9/08* (2006.01)
*B63C 9/26* (2006.01)

(52) U.S. Cl.
CPC ... *B63C 9/00* (2013.01); *B63C 9/08* (2013.01); *B63C 9/26* (2013.01)

(58) Field of Classification Search
CPC ..... B63C 9/08; B63C 9/26; B63C 9/00; A62B 1/16; A62B 1/00; B63B 35/73
USPC ..... 441/80, 81, 84, 88, 89, 125, 75
See application file for complete search history.

(56) References Cited

U.S. PATENT DOCUMENTS

| | | | | |
|---|---|---|---|---|
| 2,542,477 | A | 2/1951 | Cart | |
| 4,157,134 | A | 6/1979 | Stoll | |
| 4,713,033 | A * | 12/1987 | Cameron | 441/84 |
| 4,822,309 | A | 4/1989 | Vandenberg | |
| 4,966,279 | A * | 10/1990 | Pearcy | 206/315.11 |
| 5,230,645 | A | 7/1993 | Cheng | |
| 5,439,405 | A | 8/1995 | Storey et al. | |
| 5,653,618 | A | 8/1997 | Cheng | |
| 5,957,583 | A | 9/1999 | DeClements et al. | |
| 6,000,979 | A * | 12/1999 | Stewart | 441/75 |
| 6,257,942 | B1 * | 7/2001 | Groover | 441/84 |
| 6,568,976 | B2 * | 5/2003 | Anderson et al. | 441/80 |
| 6,800,007 | B2 * | 10/2004 | Calkin | 441/84 |

* cited by examiner

*Primary Examiner* — Lars A Olson
(74) *Attorney, Agent, or Firm* — David A. Burge

(57) ABSTRACT

A flotation tote bag is designed to bring various items to the beach, river or other water body and serve as a flotation device. In an emergency, the rescuer extends or throws the emptied flotation bag to the person in danger of drowning and pulls the victim to safety with the tether. If the victim is beyond throwing distance, the rescuer can swim offshore to victim and extend tethered flotation bag. The rescuer can then tow the victim to shore or another safe location.

1 Claim, 2 Drawing Sheets

LIFESAVING TOTE BAG

CROSS-REFERENCE TO RELATED APPLICATION

This application claims the benefit of provisional patent application Ser. No. 61/520,815 filed Jun. 15, 2011 by present inventor.

FEDERALLY SPONSORED RESEARCH

None

BACKGROUND

Prior Art

Tote bags have long been used to carry valuable accessories, especially for an excursion to the beach. Tote bags can be made of various materials and come in many sizes and styles. This new device incorporates a deployable tether with a flotation tote bag.

A number of combined inflated support and utility bags have been designed, dating back to one designed by Cart in 1951 (U.S. Pat. No. 2,542,477). This invention was a combined air cushion when inflated and a utility bag with a rectangular wire frame for carrying items. When in its unfolded, flat configuration, it provides an air mattress or cushion for sitting on the ground. The wire basket was designed to serve as an emergency life preserver when inflated manually and tossed into the water.

A bag with life-preserving buoyant means was patented by Stoll in 1979 (U.S. Pat. No. 4,157,134). This large purse-like, waterproof bag can be unfolded to form a flotation device. The bag was designed as a float and pillow; it does not carry anything.

A combined life preserver cushion and tote bag was designed by Vandenberg in 1989 (U.S. Pat. No. 4,822,309). The intent of this invention was to serve as a boat seat cushion and life preserver in an emergency situation. The square-shaped, buoyant cushions were also designed to be connected together to carry supplies such as flares, radio transmitter, food and water.

Cheng in 1993 patented a multi-purpose life preserver (U.S. Pat. No. 5,230,645) that was a rectangular sheet of flotation polyethylene that could be draped over a person's body with slits for the head and arms. This patent includes a figure showing a person floating on their back in the water, which does not make this invention useful as a rescue device. Cheng in 1997 also patented a multi-purpose flotation blanket (U.S. Pat. No. 5,653,618). This hand bag can carry things and also serve as a blanket and flotation for relaxing in the water. Another, somewhat similar device was patented by Storey and Kahl in 1995 (U.S. Pat. No. 5,439,405); it was a combined tote bag and semi-submergible floating chair/recliner and beach chair/pad.

An inflatable tote bag was developed by DeClements Jr., DeClements Sr. and McReynolds in 1999 (U.S. Pat. No. 5,957,583). This tote bag was envisioned to carry the purchases of shoppers as well as for toting items for a picnic, ball game or beach outing. When manually inflated with a valve, it can serve as a cushion and flotation device if needed. Upon inflation, the bag will float if inadvertently dropped in the water or if user and bag somehow end up in the water together.

Anderson and Way (2003; U.S. Pat. No. 6,568,976) developed a device that incorporates a deployable tether with a flotation cushion. This patent is an advancement on standard floating boat cushions, which have been long in use, by adding a tether so a person in danger of drowning can be retrieved.

SUMMARY

Considerable work has been undertaken in the field of flotation bags and cushions, but there is still an unmet need in the particular case of rescuing a person who has waded into water over their head or carried offshore by a current. Beachgoers are reluctant to carry a life preserver to the beach because of custom or other reasons, despite the fact that there are many drownings at beaches and other water bodies. However, many beachgoers take a tote bag to the beach in order to carry a range of useful items, such as towels, bathing suits, sunscreen, books, food and drink. The solution is to have flotation incorporated in the tote bag, yet allowing sufficient space for other needed items. The beach accessories can be jettisoned during an emergency, and the tethered flotation bag thrown or extended to a person in danger of drowning. If the victim is too far offshore and the rescuer is a strong swimmer, then the flotation bag can be used in a similar manner as a lifeguard rescue wherein the looped end of the tether is slung around the shoulder of the rescuer who tows ashore the victim grasping the flotation bag.

DESCRIPTION OF THE PREFERRED EMBODIMENT

Figure 1:
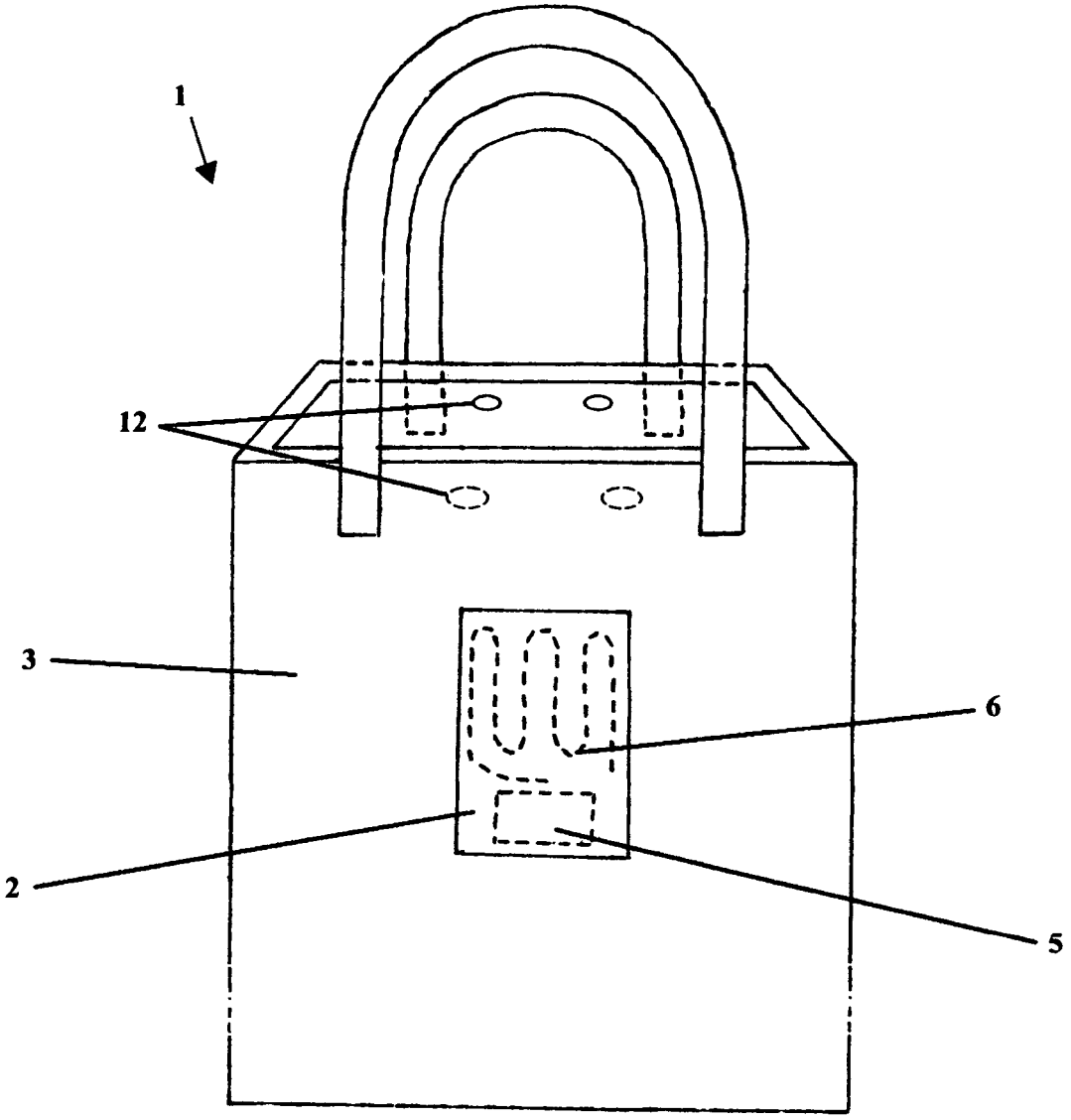
FIG. 1 illustrates a front perspective view of flotation tote bag with pocket and tether.
Figure 2:
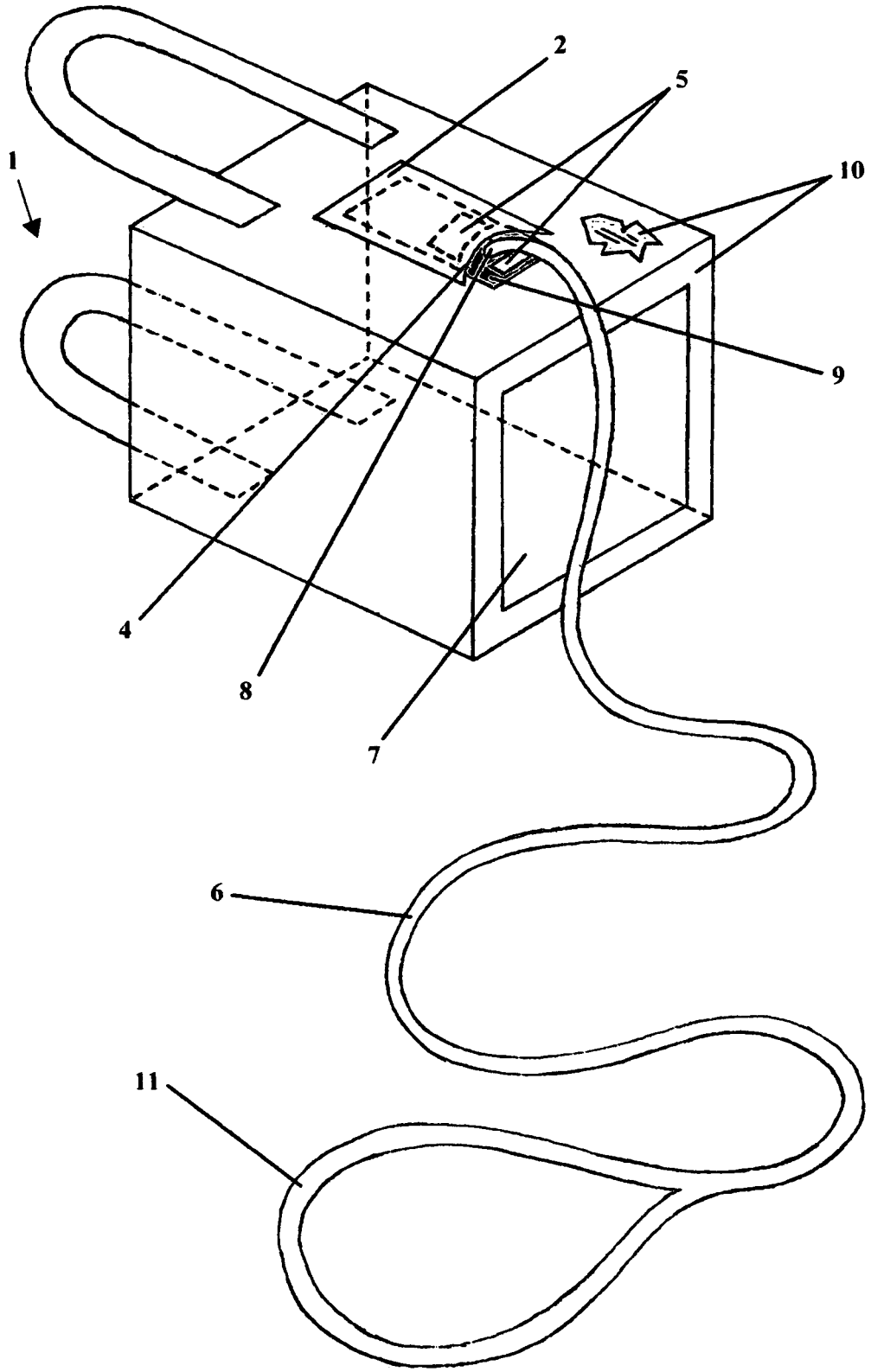
FIG. 2 illustrates a bottom perspective view of flotation tote bag with pocket open and tether deployed.

Referring to FIGS. 1 and 2, a flotation tote bag (1) has handles for carrying and a pocket (2) formed in the cover (3). The pocket (2) has opening (4) with closure elements (5) such as hook and loop, zipper or the like or a material overlay to contain a tether (6). The bottom (7) is flexible enough to allow the bag to collapse when emptied.

The tether (6) is attached at one end to the flotation tote bag and has free end. The attached end of tether (8) may be held in place by a patch (9) sewn to cover (3) or tether (6) may be attached directly to a flotation element (10). The free end may have a loop (11) to put over the shoulder of the rescuer or a hook and loop fastener for the rescuer's wrist or ankle so that he/she can move freely in case a swimming rescue is needed. The top of flotation bag may also have snaps or other fastener (12).

While the invention has been particularly shown and described with respect to the preferred embodiment thereof, it will be understood by those skilled in the art that changes in form and details may be made therein without departing from the spirit and scope of the invention.

CONCLUSIONS

Beachgoers presently have little to no means to rescue a potentially drowning person. Lifeguards are the obvious solution, but the cost is high and America's shoreline is very long. Therefore, many beaches are unguarded.

A tote bag is used by many beachgoers to carry their gear, such as towels, bathing suits, sunscreen, and snacks. The beach accessories could be jettisoned during an emergency, and the tethered flotation bag can be used to retrieve a person in danger of drowning.

I claim:

1. A collapsible, generally rectangular tote bag having four upstanding sidewalls and a bottom wall, with the sidewalls perimetrically surrounding and the bottom wall underlying an interior compartment when the bag is in an expanded state, with the interior compartment being suitable to receive, contain and transport items for use when visiting a water body, with the four upstanding sidewalls comprising flotation material, and with the bottom wall being perimetrically connected to bottom portions of the four upstanding sidewalls and being flexible enough to allow the four upstanding sidewalls of the bag to collapse when the interior compartment is empty of contents to a collapsed state forming a flotation device that can be grasped by a person in peril of drowning, and with the tote bag having an elongate tether attached near one end region of the tether to a selected one of the four upstanding sidewalls, with an opposite end region of the tether forming a loop that can be pulled on by a rescuer to tow toward a location of safety the person in peril of drowning who grasps the flotation device formed by the collapsed tote bag.

* * * * *